US011143066B2

(12) United States Patent
Murrish et al.

(10) Patent No.: US 11,143,066 B2
(45) Date of Patent: Oct. 12, 2021

(54) CRANKSHAFT ASSEMBLY WITH OILING SCHEME

(71) Applicant: GM GLOBAL TECHNOLOGY OPERATIONS LLC, Detroit, MI (US)

(72) Inventors: Dale E. Murrish, Troy, MI (US); Luke Luehr, Farmington Hills, MI (US); Scott A. Hucker, Ortonville, MI (US); Varoon Shankar, Farmington Hills, MI (US); Jeremy T. Demarest, Waterford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 400 days.

(21) Appl. No.: 16/237,883

(22) Filed: Jan. 2, 2019

(65) Prior Publication Data

US 2020/0208548 A1 Jul. 2, 2020

(51) Int. Cl.

| | |
|---|---|
| ***F01M 1/06*** | (2006.01) |
| ***F01M 11/02*** | (2006.01) |
| ***F01M 1/16*** | (2006.01) |
| ***F01M 1/08*** | (2006.01) |

(52) U.S. Cl.

CPC ..... *F01M 1/06* (2013.01); *F01M 1/08* (2013.01); *F01M 1/16* (2013.01); *F01M 11/02* (2013.01); *F01M 2001/062* (2013.01)

(58) Field of Classification Search

CPC .. F01M 1/06; F01M 1/08; F01M 1/16; F01M 2001/062; F01M 2001/086; F01M 11/02; F01M 2011/026

See application file for complete search history.

(56) References Cited

U.S. PATENT DOCUMENTS

| | | | | |
|---|---|---|---|---|
| 5,707,187 | A * | 1/1998 | Arnold | B23C 3/06 409/200 |
| 6,155,575 | A * | 12/2000 | Hawkins | F01M 1/06 123/196 R |
| 7,249,577 | B1 | 7/2007 | Zhang et al. | |
| 2008/0190699 | A1 * | 8/2008 | Ohta | F01M 1/06 184/6.5 |
| 2017/0241299 | A1 | 8/2017 | Murrish et al. | |
| 2017/0241471 | A1 | 8/2017 | Murrish et al. | |
| 2017/0241473 | A1 | 8/2017 | Murrish et al. | |

* cited by examiner

*Primary Examiner* — Jacob M Amick

(57) ABSTRACT

A crankshaft assembly for a vehicle, a method of operating a crankshaft assembly, and a method of manufacturing a crankshaft assembly. The crankshaft assembly includes a crankshaft, a first pin bearing journal and a main journal, an oil passage having a main passage wall, the oil passage extending from the first pin bearing journal to or through the main bearing journal, a crankpin exit hole located in the main passage wall, and a blocking element positioned in the oil passage, wherein the blocking element is located in a radially outward position with respect to the crankpin exit hole.

18 Claims, 3 Drawing Sheets

CRANKSHAFT ASSEMBLY WITH OILING SCHEME

INTRODUCTION

The field of technology generally relates to crankshaft assemblies for vehicles and, more particularly, to crankshaft assembly flow passages and methods of manufacture.

A proper oiling scheme for the various bearings of a vehicle crankshaft assembly can help reduce the likelihood of bearing failures. Accordingly, a more robust oiling scheme can be advantageous, because providing more oil to the rods can help in scenarios such as when the vehicle is restarted after being stopped.

SUMMARY

According to one embodiment, there is provided a crankshaft assembly for a vehicle, comprising: a crankshaft; a first pin bearing journal; a main bearing journal; an oil passage having a main passage wall, the oil passage extending from the first pin bearing journal to or through the main bearing journal; a crankpin exit hole located in the main passage wall; and a blocking element positioned in the oil passage, wherein the blocking element is located in a radially outward position with respect to the crankpin exit hole.

According to various embodiments, this assembly may further include any one of the following features or any technically-feasible combination of these features:

- the oil passage extends from an outer surface of the first pin bearing journal through the main bearing journal, to an outer surface of a second pin bearing journal;
- the oil passage includes an expanded exit portion at the first pin bearing journal and a channel portion located radially inward with respect to the expanded exit portion at the first pin bearing journal;
- a diameter of the expanded exit portion is greater than a diameter of the channel portion;
- a diameter of the crankpin exit hole is smaller than the diameter of the channel portion;
- the blocking element is configured to block oil from the crankpin exit hole and the channel portion from flowing out of the expanded exit portion;
- a second expanded exit portion at the second pin bearing journal;
- the blocking element is a check valve at least partially seated at a stepped transition portion between the expanded exit portion and the channel portion;
- the check valve is a spring biased check ball, a reed valve, or a reverse flow check valve;
- a second blocking element located in a radially outward position with respect to the crankpin exit hole;
- the blocking element is a ball and the second blocking element is a puck core plug or a cup core plug;
- the blocking element is a puck core plug or a cup core plug;
- a second blocking element located in a radially inward position with respect to the crankpin exit hole;
- the oil passage includes an expanded internal portion along a channel portion;
- the expanded internal portion is located radially inward with respect to the crankpin exit hole;
- a diameter of the expanded internal portion is greater than a diameter of the channel portion;
- the crankpin exit hole is concentric with a cross-sectional rounded perimeter of the expanded internal portion; and/or According to one embodiment, there is provided a crankshaft assembly for a vehicle, comprising: a crankshaft; a first pin bearing journal and a second pin bearing journal; a main bearing journal configured at least partially between the first pin bearing journal and the second pin bearing journal; an oil passage having a main passage wall, an expanded exit portion, a channel portion, and an expanded internal portion; a blocking element in the oil passage; and a crankpin exit hole connected to the main passage wall, wherein the expanded internal portion is located radially inward with respect to the crankpin exit hole.

According to another embodiment, there is provided a method of manufacturing the crankshaft assembly, comprising the step of maintaining at least 30% oil by volume between the blocking element and a second blocking element.

According to one embodiment, there is provided a crankshaft assembly for a vehicle, comprising: a crankshaft; a first pin bearing journal; a main bearing journal; an oil passage having a main passage wall, an expanded exit portion, a channel portion, and a stepped transition portion between the expanded exit portion and the channel portion; and a crankpin exit hole connecting to the main passage wall, wherein the crankpin exit hole is located between the expanded exit portion and the channel portion in the stepped transition portion.

BRIEF DESCRIPTION OF THE DRAWINGS

Preferred exemplary embodiments will hereinafter be described in conjunction with the appended drawings, wherein like designations denote like elements, and wherein.

DETAILED DESCRIPTION

The assembly, manufacturing method, and operating method described herein relate to crankshaft oil passages. The oil passage is configured to include one or more crankpin holes and/or one or more blocking elements that are particularly arranged to help with priming and lubrication of the various bearings on the crankshaft. Additionally, the oil passage can have various expanded portions that may impact fluid flow, and can also decrease the weight of the crankshaft assembly, which is advantageous, particularly with automotive product designs. However, the volume and configuration of the oil passage may be limited in view of the stress tolerance necessary for proper crankshaft performance. Stated differently, areas of the crankshaft should have a sufficient thickness in order for the crankshaft to adequately bear imposed stresses. The presently disclosed crankshaft assembly embodiments help balance these interests while advantageously enabling an improved oiling scheme.

Figure 1:
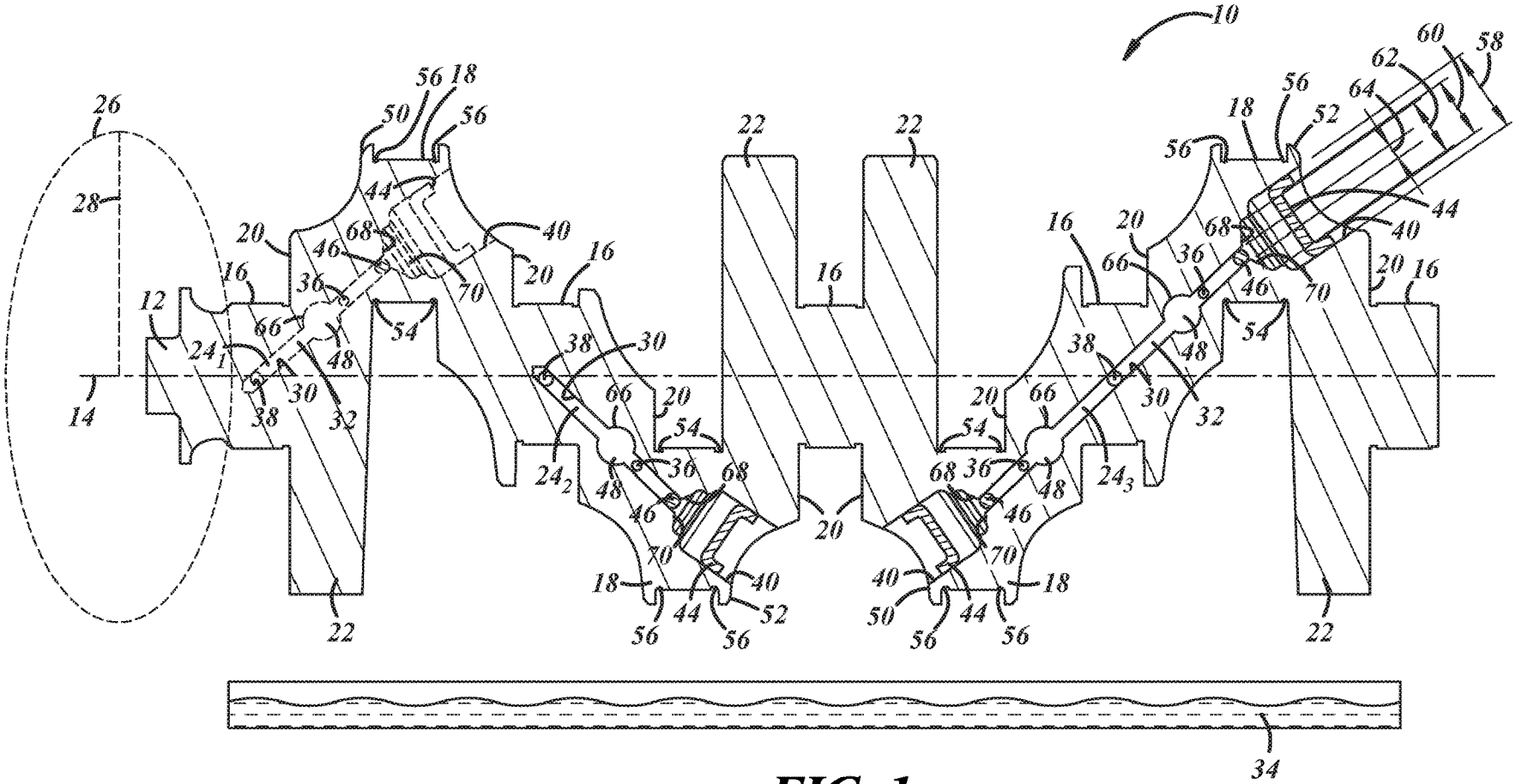
FIG. 1 is a cross-section view of a crankshaft assembly having oil passages in accordance with one embodiment.
Figure 2:
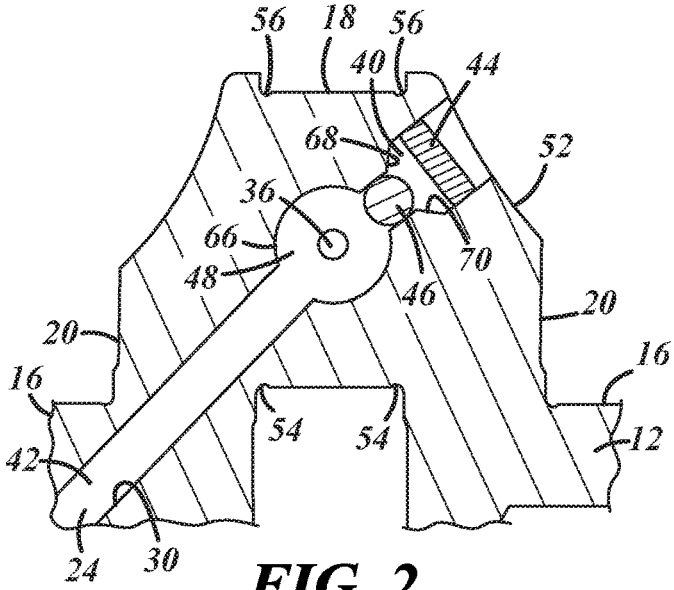
FIG. 2 shows an oil passage in a pin bearing journal in accordance with one embodiment.

FIG. 1 illustrates a crankshaft assembly 10. The crankshaft assembly 10 includes crankshaft 12 that generally extends along a longitudinal axis 14. The crankshaft 12 defines a plurality of main bearing journals 16, a plurality of pin bearing journals 18, a plurality of arms 20 that extend between the main bearing journals and pin bearing journals, and at least one counterweight 22. As will be detailed further below, the crankshaft assembly 10 includes one or more particularly configured oil passages 24 that facilitate proper lubrication of bearings (not shown) on the main bearing journals 16 and/or the pin bearing journals 18.

The main bearing journals 16 attach the crankshaft 12 to an engine block. The main bearing journals 16 are disposed concentrically about the longitudinal axis 14, whereas the pin bearing journals 18 are offset from the longitudinal axis 14. The pin bearing journals 18 attach to a reciprocating engine piston via a connecting rod. Force applied from the piston to the crankshaft 12 through the offset connection therebetween generates torque in the crankshaft, which rotates the crankshaft about the longitudinal axis 14. The rotational pattern 26 around the longitudinal axis 14 is generally defined by a rotation radius 28 between the radially outermost portion of the crankshaft 12 and the longitudinal axis.

The counterweights 22 extend radially away from the longitudinal axis 14 and serve to offset the reciprocating mass of the pistons, piston rings, piston pins and retaining clips, the small ends of the connecting rods, and the rotating mass of the connecting rod large ends and bearings, as well as the rotating mass of the crankshaft itself (the pin bearing journals 18 and the arms 20). The main bearing journals 16 are on the longitudinal axis 14 and do not require any counterweights. The counterweights 22 reduce the forces acting on the main bearing journals 16 and thereby improve durability of the bearings. The counterweights 22 help balance the rotation of the crankshaft 12 about the longitudinal axis 14 to reduce vibration thereon. The crankshaft assembly 10 may have any operable number of counterweights 22 attached to the various arms 20 in any operable configuration.

The embodiment of the crankshaft assembly 10 shown in FIG. 1 is for an inline four cylinder engine, and includes four pin bearing journals 18, eight arms 20, five main bearing journals 26, and four counterweights 22. However, it should be appreciated that the crankshaft assembly 10 may be configured differently than what is illustrated in FIG. 1. In some embodiments, the crankshaft assembly 10 may include a non-planar crankshaft, or, the crankshaft assembly 10 may be configured for a different style and/or configuration of engine, including but not limited to a V style engine (e.g., an engine having two banks of cylinders arranged in a V to form a valley therebetween) having six or eight cylinders, or an inline style of engine having 3, 5, 6, or some other number of cylinders. The crankshaft may be a shared-pin V crankshaft, which has two rods per pin bearing journal such as a V8 or V12 engine. The crankshaft assembly 10 may include a V crankshaft with a "flying arm" in between two rod or pin bearing journals. V6 engines have four main bearings and two rods between each main bearing. A 60° (bank angle between cylinders) V6 crankshaft has a thick flying arm between crankpins since there is a 60° pin splay, and a 90° V6 has a thinner flying arm (only a 30° pin splay in the end view). The structure, dimensions, configurations, etc. of the crankshaft assembly 10 can vary from what is illustrated in FIG. 1, as such considerations are largely dictated by the needs of the particular engine.

The crankshaft assembly 10 illustrated in FIG. 1 is for a vehicle engine, which could be a gasoline or diesel powered internal combustion engine, although it could be used in other applications, such as with a compressor to cite one example. The crankshaft assembly 10 can be used in passenger cars, motorcycles, trucks, sports utility vehicles (SUVs), recreational vehicles (RVs), marine vessels, aircraft, etc. In an advantageous embodiment, the crankshaft 12 is cast iron or steel, although it may be possible to use another operable material. With cast iron or steel, the various internal features such as the oil passages 24 can be partially cast or drilled, as described in further detail below. The larger passages are sometimes cast in cast iron crankshafts.

FIG. 1 shows three potential embodiments of an oil passage 24 (see $\mathbf{24}_1$, $\mathbf{24}_2$, $\mathbf{24}_3$). Each oil passage 24 is generally defined by a main passage wall 30. The main passage wall 30 forms an internal bore 32 which can be filled or partially filled with oil 34, which is schematically illustrated in FIG. 1. The oil 34 can enter/exit the internal bore 32 via main journal hole(s) 38 and/or crankpin exit hole(s) 36, which are located in the main passage wall 30. Other features of the oil passage 24 illustrated in FIG. 1 include expanded exit portions 40 which are situated on either end of a channel portion 42, core plug blocking elements 44, ball blocking elements 46, and expanded internal portions 48.

In an advantageous embodiment (e.g. oil passage $\mathbf{24}_3$ in FIG. 1), the oil passage 24 can extend from an outer surface 50 of a first pin bearing journal 18, through a first arm 20, through the main bearing journal 16, through a second arm 20, and to an outer surface 52 of a second pin bearing journal 18. While the oil passage 24 is illustrated as generally maximizing the axial extent or reach from each of the pin bearing journals 18, other configurations are possible. For example, in a V8 embodiment, the channel portion 42 could project off the expanded exit portion 40 at a sharp angle instead of generally being in-line with the expanded exit portion 40. In some embodiments, as illustrated with the oil passage $\mathbf{24}_3$ in FIG. 1, the oil passage is symmetrical with respect to the centrally located main journal hole 38, which is generally aligned with the longitudinal axis 14.

The crankpin exit holes 36 and the main journal hole 38 can be strategically positioned along the oil passage 24 to facilitate lubrication of the various bearings installed on the crankshaft 12. In an advantageous embodiment, as illustrated with oil passage $\mathbf{24}_3$ in FIG. 1, the oil passage includes a main journal hole 38 that is sometimes perpendicular to the longitudinal axis 14, with one or more crankpin exit holes 36 that are located in a radially outward position with respect to the main journal hole 38. With the oil passage $\mathbf{24}_1$ in FIG. 1, the oil passage 24 can exit the main journal 16 in a single exit without one or more holes 38. The oil passage $\mathbf{24}_1$ is illustrated in dotted lines to show that it is possible for the passage and the various holes 36, 38 to be in a different plane. For example, it is possible either of the holes 36, 38 to have more of an elliptically shaped cross-section at the intersection with the main passage wall 30. With the oil passage $\mathbf{24}_2$ in FIG. 1, there can be more than one hole at the exit where a single pin bearing journal is fed from a single main journal. It is understood that there may be several possible configurations not particularly shown or described here which fall into the scope of the present application. Positional terms such as "radially outward" and "radially inward" are used with respect to the rotational pattern 26 and the rotation radius 28. For example, the furthest radially outward position would be closest to the rotational pattern 26 along the rotation radius 28, whereas the furthest radially inward position would be closest to the longitudinal axis 14, which is generally the center point of rotation. The crankpin exit holes 36 and the main journal hole 38 can be cross-drilled to join an outer surface 50, 52 of the pin bearing journals or an outer surface of the main bearing journal, respectively. In FIG. 1, the crankpin exit holes 36 are shown as being closer to the arm for clarity purposes in the schematic representation of the crankshaft 12, in order to more clearly show the various components of the oil passages $\mathbf{24}_1$, $\mathbf{24}_2$, $\mathbf{24}_3$. However, advantageously, the crankpin exit holes 36 are more centrally located in the pin bearing journals 18, as shown in FIGS. 2-7.

Expanded exit portions 40 are located in the pin bearing journals 18 (e.g. in FIGS. 1, 2, 3, 5, 6, and 7). The expanded exit portions 40 can be designed so as to minimize the size and/or mass of the crankshaft assembly 10, which accordingly reduces the size and/or mass of the engine, which has a compounding effect on the overall size, mass, and fuel economy of the vehicle. Thus, the volume of the expanded exit portions 40 can be maximized to encourage lightening of the crankshaft assembly 10 and a more optimal sized oil reservoir for oil 34, yet the remaining material must be sufficient to withstand the high stresses experienced at the pin bearing journals 18 due to loading by the connecting rods. The expanded exit portions 40 are accordingly arranged to avoid, or be adequately spaced from, lower fillets 54 and upper fillets 56, which can be high stress areas. In an advantageous embodiment, the expanded exit portions 40 have a diameter 58 which is greater than a diameter 60 of the expanded internal portion 48. The diameter 60 of the expanded internal portion 48 is greater than a diameter 62 of the channel portion 42. Accordingly, the diameter 58 of the expanded exit portions 40 is greater than the diameter 62 of the channel portions 42. Additionally, a diameter 64 of the crankpin exit hole 36 is smaller than the diameter 62 of the channel portion 42. Thus, the diameters 58, 60, 62 are all greater than the diameter 64 of the crankpin exit hole 36. The diameters 58, 60, 62, 64 will depend on various factors, including but not limited to the overall size of the crankshaft 12, the desired oiling scheme, and/or the necessary stress tolerances. In one embodiment, the diameter 62 of the channel portion 42 is about 5-6 mm or larger.

Core plug blocking elements 44 can be situated in the expanded exit portions 40 to help accommodate the loads placed on the pin bearing journals 18. The core plug blocking elements 44 can be formed from the same material as the crankshaft 12, or a different material. Some potential materials include steel, aluminum, titanium, ceramic, a metal matrix, or a composite. Example core plug blocking elements 44 and their configuration, structure, etc. with respect to the crankshaft assembly 10 are detailed in U.S. patent application Ser. No. 15/048,333 filed on Mar. 16, 2016, assigned to the Applicant of the present application, and incorporated by reference in its entirety herein. In the embodiment illustrated in FIG. 1, the core plug blocking elements 44 are cup core plugs that have a cup-shape that generally coincides with the shape of the expanded exit portions 40, and as will be detailed below, other shapes and configurations for the core plug blocking elements 44 are certainly possible. The core plug blocking elements 44 optionally include one or more openings to allow the passage of oil 34 from the channel portion 42 out of the expanded exit portion 40. The presence or absence of openings in the core plug blocking elements 44 will depend on the desired oiling scheme, as will be detailed further below. The core plug blocking elements 44 are generally located within the oil passage 24 in a radially outward location with respect to the crankpin exit holes 36 and a radially inward location with respect to the outer surfaces 50, 52 of the pin bearing journals 18. Additionally, when a second blocking element is employed in the oil passage 24 in addition to the core plug blocking element 44, the core plug blocking element 44 will be generally located in a radially outward location with respect to the second blocking element.

Ball blocking elements 46 may be used as a second blocking element in addition to the core plug blocking element 44, as illustrated in FIG. 1, or in some embodiments, the ball blocking element 46 (or an alternatively shaped blocking element) may be used as the only or first blocking element. It is possible for the first blocking element or the second blocking element to take various forms or configurations, so long as the internal bore 30 is mostly or entirely blocked by the element. The ball blocking elements 46 may be formed from a material similar to the core plug blocking element 44, or another operable material. The ball blocking elements 46 can be press-fit into the channel portion 42 to further control the flow of oil 34 through the internal bore 32 of the oil passage 24. The diameter of the ball blocking elements 46 can accordingly be quite close to the diameter 62 of the channel portion 42 to facilitate the press-fit attachment. The ball blocking elements 46 are typically located in a radially outward position with respect to the crankpin exit holes 36. In the embodiment illustrated in FIG. 1, the ball blocking elements 46 are located in a radially outward position with respect to the crankpin exit holes 36. This arrangement may be advantageous in embodiments where an expanded internal portion 48 is included to help promote the flow of oil 34 in through the crankpin exit holes 36 to the internal bore 32 of the oil passage 24.

Expanded internal portions 48, as illustrated in FIG. 1, can be used in some embodiments help regulate the flow of oil 34 through the internal bore 32 of the oil passage 24. The expanded internal portion 48 is advantageously located along the channel portion 42 to encourage additional oil flow from the main journal entrance hole(s) 38 into the oil passage 24. Having the volumetrically expanded portion 48 at or near the crankpin exit holes 36 can increase the flow rate of the oil 34 through the crankpin exit holes 36 to promote more efficient lubrication of the various components of the crankshaft assembly 10. In a further advantageous embodiment (e.g. FIGS. 1, 2, 4, and 5), the expanded internal portion 48 is located radially inward with respect to the crankpin exit hole 36. This arrangement can help provide a more efficient oiling scheme. While generally shown as being spherical in shape, the expanded internal portions 48 could be alternately shaped or configured, depending on the desired implementation.

The expanded internal portion 48 includes, in some embodiments, a cross-sectional rounded perimeter 66. The spherical shape can be more advantageous from a fluid dynamics perspective, and it can be easier to manufacture. If the spherical rounded perimeter 66 is offset from the center of the oil passage 24 forming an elliptical shape, the oil flow is enhanced. It is to be understood that there may be many possible arrangements of the expanded internal portion 48 to facilitate more oil flow to the crankpin exit holes 36. As described above, in the FIG. 1 embodiment, the expanded internal portion 48 is located in the channel portion 42 at a location radially inward from the crankpin exit hole 36. In other embodiments, such as the embodiment illustrated in FIG. 2, the crankpin exit hole 36 is concentric with the cross-sectional rounded perimeter 66. In yet other embodiments, the crankpin exit hole 36 may be located generally within the bounds of the expanded internal portion 48 instead of having the expanded internal portion 48 located radially inward with respect to the crankpin exit hole 36.

FIGS. 2-6 illustrate various other embodiments of the oil passage 24. As described above, in FIG. 2, the crankpin exit hole 36 is concentric with the cross-sectional rounded perimeter 66 of the expanded internal portion 48. The core plug blocking element 44 in this embodiment is a puck core plug instead of a cup core plug. The ball blocking element 46 is located just radially inward of a stepped transition portion 68. The stepped transition portion 68 could have multiple internal steps or shoulders, or it can be structured as a counterbore chamfer 70, as illustrated. The expanded internal portion 48 may be spaced further from the fillet 54 than what is illustrated, and this spacing may be optimized to handle the applied loads.

Figure 3:
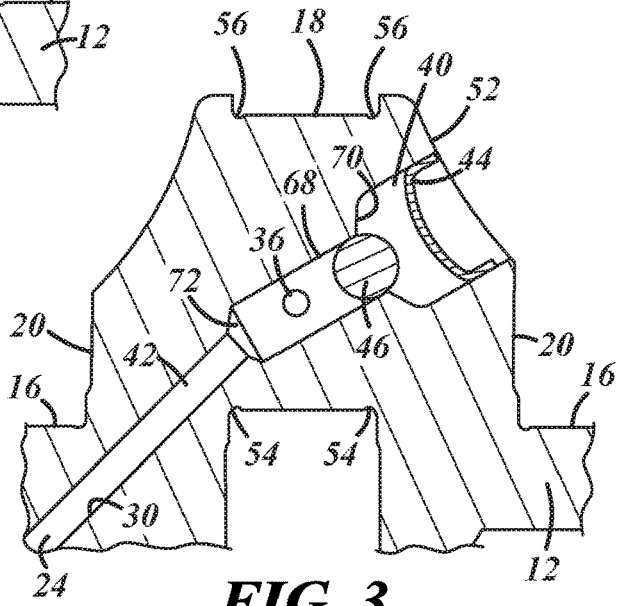
FIG. 3 shows an oil passage in a pin bearing journal in accordance with another embodiment.

In FIG. 3, the stepped transition portion 68 has a counterbore chamfer 70 that transitions the expanded exit portion 40 into the stepped transition portion 68, and then a second counterbore chamfer 72 that transitions the transition portion 68 into the channel portion 42. The ball blocking element 46 is seated in the transition portion 68. Additionally, the crankpin exit hole 36 is located in the transition portion 68. Since the transition portion has a diameter that is between the diameter 58 of the expanded exit portion 40 and the diameter 62 of the channel portion 42 in terms of size (see, e.g., FIG. 1), locating the crankpin hole 36 in this area may improve fluid transfer capabilities.

Figure 4:
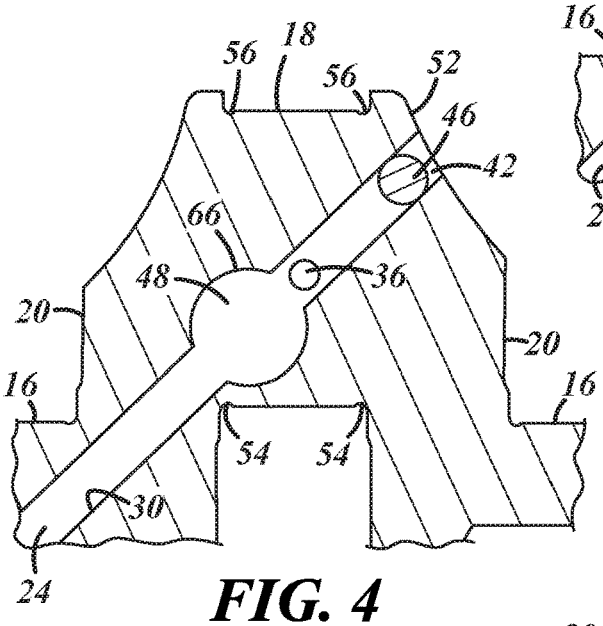
FIG. 4 shows an oil passage in a pin bearing journal in accordance with another embodiment.

FIG. 4 illustrates an oil passage 24 that does not have an expanded exit portion 40. In this embodiment, the channel portion 42 extends from the outer surface 52 of one pin bearing journal 18, to the main bearing journal 16, to the outer surface of another pin bearing journal. As with the FIG. 2 embodiment, the expanded internal portion 48 may be spaced further from the fillet 54 than what is illustrated, and this spacing may be optimized to handle the applied loads. The FIG. 4 embodiment also only has a single ball blocking element 46, which is located radially outward with respect to the crankpin exit hole 36. This embodiment does not have an expanded exit portion 40, which can help stiffen the crank arm and reduce mass.

Figure 5:
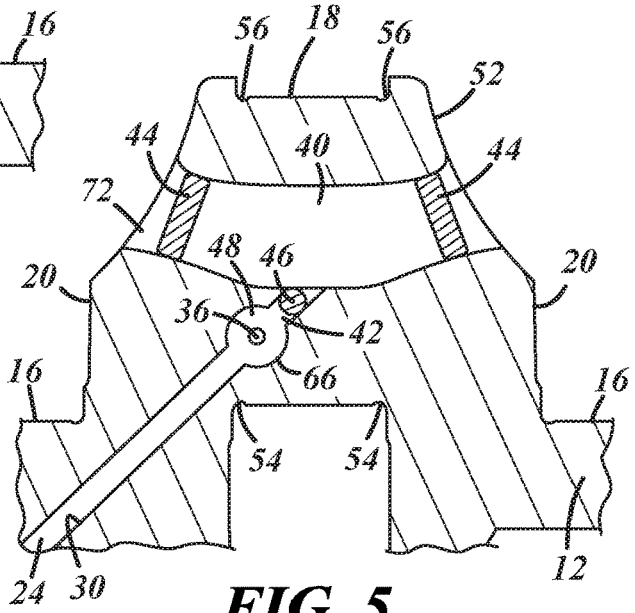
FIG. 5 shows an oil passage in a pin bearing journal in accordance with another embodiment.

FIG. 5 shows an alternate variation to the expanded exit portion 40. This embodiment includes an additional exit 72 along the outer surface 52 of the pin bearing journal 18. Additionally, this expanded exit portion 40 has a larger cavity volume, and accordingly, an additional core plug blocking element 44 is used to add structural support to the pin bearing journal 18. This embodiment may be advantageous in scenarios where further lightening of the overall crankshaft assembly 10 is desired. In some embodiments where the expanded exit portion 40 has an additional exit 72 or larger cavity volume, the crankpin hole 36 may be more centrally located than what is illustrated in FIG. 5.

Figure 6:
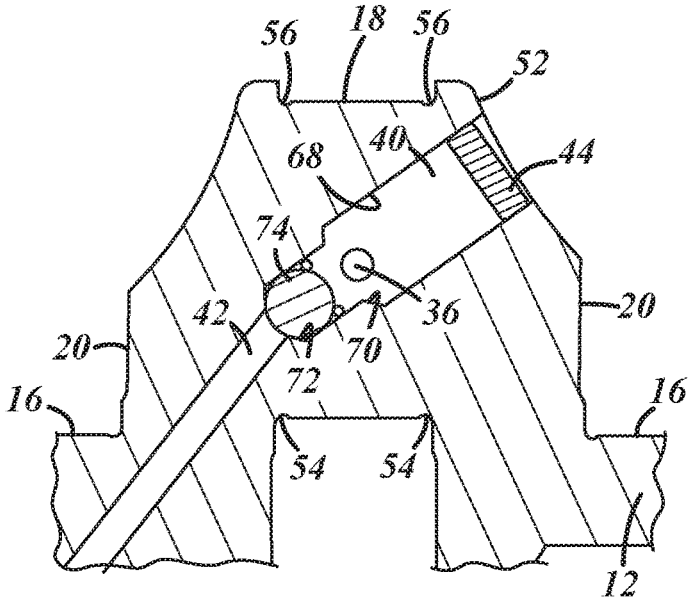
FIG. 6 shows an oil passage in a pin bearing journal in accordance with another embodiment.
Figure 7:
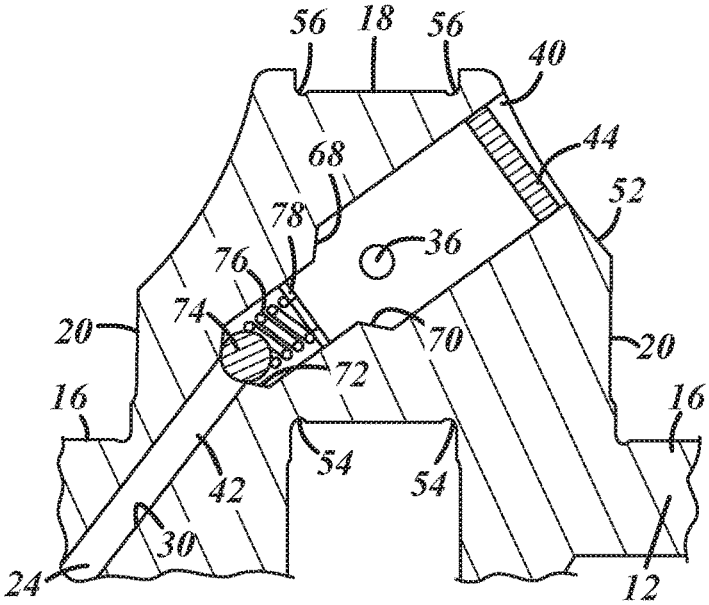
FIG. 7 shows an oil passage in a pin bearing journal in accordance with another embodiment.

FIGS. 6 and 7 illustrate alternate embodiments where the blocking element includes a check valve 74. The check valve 74 can be seated in the stepped transition portion 68, and more particularly, in one of the counterbore chamfers 70, 72. The check valve 74 in the FIG. 6 embodiment may be similar to a ball point pen style valve. Additionally, in the embodiments of FIGS. 6 and 7, the crankpin exit hole 36 is located in the expanded exit portion 40. This arrangement allows for oil 34 to be maintained within the expanded exit portion 40, with the check valve 74 preventing most backflow through to the channel portion 42. This can be advantageous for operational purposes. According to one method of operating the crankshaft assembly 10, the crankpin exit hole 36 and blocking elements 44 or 74, and 46 are positioned so as to maintain some oil 34 in the area between the blocking elements. For example, the amount of oil in this area could be at least 30-50%, and advantageously, over 50% by volume. Accordingly, this area would not be more than half dry when the engine is stopped in a horizontal orientation for a significant period of time (e.g., about 8-10 hours). Having the oil passage 24 half primed all of the time, and fully primed after a few crank rotations, can help prevent bearing failures. Moreover, in some embodiments, combining the check valve blocking element 74 and core plug blocking element 44 can increase robustness of the oiling scheme, while allowing for smaller bearings.

Figure 8:
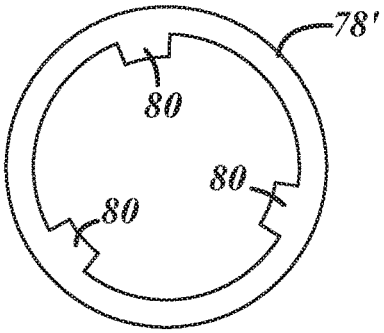
FIG. 8 shows a retainer that may be used with the oil passage and pin bearing journal of FIG. 7.
Figure 9:
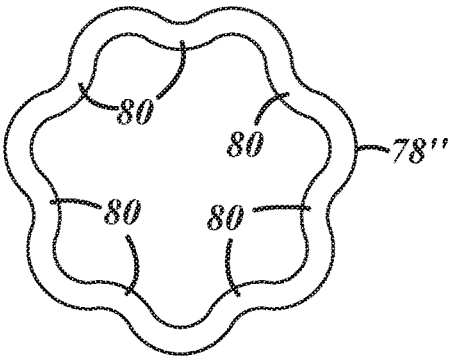
FIG. 9 shows another embodiment of a retainer that may be used with the oil passage and pin bearing journal of FIG. 7.
Figure 10:
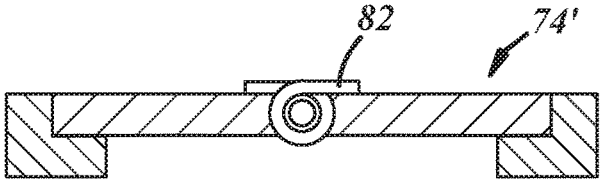
FIG. 10 shows another embodiment of a blocking element that could be used in an oil passage of a pin bearing journal.

In FIG. 7, the check valve 74 is a spring biased check ball that includes a spring 76 and retainer ring 78. Besides just a generally cylindrical retainer ring 78, other embodiments of the retainer ring 78', 78" are illustrated in FIGS. 8 and 9, respectively. The retainer rings 78', 78" have radial projections 80 that help maintain the ball in a desired position in the oil passage 24. FIG. 10 illustrates another embodiment of a check valve, which is a reed valve 74'. This embodiment includes a hinge 82 that only opens when pressure is exerted from a radially inward location in the channel portion 42 out toward the expanded exit portion 40. Accordingly, with the check valves 74, 74', backflow can be prevented or minimized. Other types of check valves may be included as an alternative to those illustrated, such as an 855 series reverse flow check valve, to cite one example.

Various techniques can be employed to manufacture the crankshaft assembly 10 and its features. In an advantageous embodiment, the oil passage 24, or at least a portion thereof, such as the expanded internal portion 48, is milled in an orbital pattern to create the dimensional variation in the main passage wall 30. In an advantageous embodiment, a trochoidal milling technique is used for the orbital milling pattern. Small diameter tooling may be used to create features such as the crankpin exit holes 36. In another advantageous embodiment, drilling the crankpin exit holes 36 is accomplished using a high axial load with gradually increasing or stepping up the feed rate.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the specific combination and order of steps is just one possibility, as the present method may include a combination of steps that has fewer, greater or different steps than that shown here. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A crankshaft assembly for a vehicle, comprising:

a crankshaft;

a first pin bearing journal;

a main bearing journal;

an oil passage having a main passage wall, the oil passage extending from the first pin bearing journal to or through the main bearing journal, wherein the oil passage includes an expanded internal portion along a channel portion;

a crankpin exit hole connecting to the main passage wall, wherein the crankpin exit hole is concentric with a cross-sectional rounded perimeter of the expanded internal portion; and a blocking element positioned in the oil passage, wherein the blocking element is located in a radially outward position with respect to the crankpin exit hole.

2. The assembly of claim 1, wherein the oil passage extends from an outer surface of the first pin bearing journal, through the main bearing journal, to an outer surface of a second pin bearing journal.

3. The assembly of claim 1, wherein the oil passage includes an expanded exit portion at the first pin bearing journal and the channel portion is located radially inward with respect to the expanded exit portion at the first pin bearing journal.

4. The assembly of claim 3, wherein a diameter of the expanded exit portion is greater than a diameter of the channel portion.

5. The assembly of claim 4, wherein a diameter of the crankpin exit hole is smaller than the diameter of the channel portion.

6. The assembly of claim 3, wherein the blocking element is configured to block oil from the crankpin exit hole and the channel portion from flowing out of the expanded exit portion.

7. The assembly of claim 2, further comprising a second expanded exit portion at the second pin bearing journal.

8. The assembly of claim 3, wherein the blocking element is a check valve at least partially seated at a stepped transition portion between the expanded exit portion and the channel portion.

9. The assembly of claim 8, wherein the check valve is a spring biased check ball, a reed valve, or a reverse flow check valve.

10. The assembly of claim 1, further comprising a second blocking element located in a radially outward position with respect to the crankpin exit hole.

11. The assembly of claim 10, wherein the blocking element is a ball and the second blocking element is a puck core plug or a cup core plug.

12. The assembly of claim 1, wherein the blocking element is a puck core plug or a cup core plug.

13. The assembly of claim 12, further comprising a second blocking element located in a radially inward position with respect to the crankpin exit hole.

14. The assembly of claim 1, wherein the expanded internal portion is located radially inward with respect to the crankpin exit hole.

15. The assembly of claim 1, wherein a diameter of the expanded internal portion is greater than a diameter of the channel portion.

16. A crankshaft assembly for a vehicle, comprising:

a crankshaft;

a first pin bearing journal and a second pin bearing journal;

a main bearing journal configured at least partially between the first pin bearing journal and the second pin bearing journal;

an oil passage having a main passage wall, an expanded exit portion, a channel portion, and an expanded internal portion, wherein the oil passage includes an expanded exit portion at the first pin bearing journal and a channel portion located radially inward with respect to the expanded exit portion at the first pin bearing journal;

a blocking element in the oil passage, wherein the blocking element is a check valve at least partially seated at a stepped transition portion between the expanded exit portion and the channel portion; and a crankpin exit hole connected to the main passage wall, wherein the expanded internal portion is located radially inward with respect to the crankpin exit hole.

17. A method of manufacturing the crankshaft assembly of claim 16, comprising the step of milling in an orbital pattern to create at least a portion of the main passage wall.

18. A crankshaft assembly for a vehicle, comprising:

a crankshaft;

a first pin bearing journal;

a main bearing journal;

an oil passage having a main passage wall, an expanded exit portion, a channel portion, and a stepped transition portion between the expanded exit portion and the channel portion; and a crankpin exit hole connecting to the main passage wall, wherein the crankpin exit hole is located between the expanded exit portion and the channel portion in the stepped transition portion.

* * * * *